US012262757B2

(12) United States Patent
Stall

(10) Patent No.: US 12,262,757 B2
(45) Date of Patent: Apr. 1, 2025

(54) BRASS SMOKING PIPE

(71) Applicant: Brian Stall, Merrimack, NH (US)

(72) Inventor: Brian Stall, Merrimack, NH (US)

( * ) Notice: Subject to any disclaimer, the term of this patent is extended or adjusted under 35 U.S.C. 154(b) by 321 days.

(21) Appl. No.: 17/902,844

(22) Filed: Sep. 4, 2022

(65) Prior Publication Data

US 2024/0074491 A1 Mar. 7, 2024

(51) Int. Cl.
*A24F 5/00* (2006.01)
*A24F 1/32* (2006.01)

(52) U.S. Cl.
CPC . *A24F 5/00* (2013.01); *A24F 1/32* (2013.01)

(58) Field of Classification Search
None
See application file for complete search history.

(56) References Cited

U.S. PATENT DOCUMENTS

| | | | | |
|---|---|---|---|---|
| 909,903 | A * | 1/1909 | Hutis | A24F 1/08 131/229 |
| 1,214,887 | A * | 2/1917 | Burger | A24F 1/00 131/204 |
| 1,929,557 | A * | 10/1933 | McClenahan | A24F 9/14 131/184.2 |
| 11,058,148 | B2 * | 7/2021 | Hoch | B29C 45/14819 |
| 2019/0208810 | A1 * | 7/2019 | Stall | G10D 9/03 |

* cited by examiner

*Primary Examiner* — Philip Y Louie
*Assistant Examiner* — Madeleine P Delacruz
(74) *Attorney, Agent, or Firm* — Lambert Shortell & Connaughton; David J. Connaughton, Jr.; Justin P. Tinger

(57) ABSTRACT

A tobacco pipe comprising a tobacco burning chamber, a stem having a bore communicating with the interior of the chamber, wherein the chamber comprises a brass musical instrument mouthpiece, and the stem comprises the lead tube of a brass musical instrument.

6 Claims, 2 Drawing Sheets

BRASS SMOKING PIPE

FIELD OF THE INVENTION

The invention relates to tobacco pipes

Background of the Invention

Smoking pipes have long been a popular way of smoking tobacco and usually comprise a generally cup-shaped bowl having a stem projecting from one side of the bowl and communicating with the central recess of the bowl to allow the user to draw air and smoke through the bowl and stem into the user's mouth.

The use of pipes for smoking dates back hundreds of years, and the qualities of good pipes are well known to all smokers. Perhaps the most important of these qualities is taste. A pipe must be sufficiently neutral so that the smoker will be able to taste the tobacco which he has chosen. This quality of proper taste is perhaps the most difficult quality to obtain when a pipe is chosen.

Other qualities which good pipes must provide include a cool and dry smoke having an agreeable and mild taste and one which is absolutely free from biting and disagreeable effects.

Another quality that good pipes have is the quality of not requiring extensive "breaking in", that is, pre-smoking, before normal use. However, many such pipes are expensive and difficult to make.

High quality pipes can be provided from bowls made of briar or meerschaum, as is known in the art. Briar is a root of a particular bush or tree, having a woody structure but being relatively hard, impervious, and resistant to burning. Meerschaum is a mineral substance, seprilite, which is imported from Asia Minor. This mineral is a fine, porous, clay-like material which is soft and light in weight, and does not impart a foreign taste or odor to burning tobacco.

Although high quality briar and meerschaum are excellent materials for smoking pipes, they are becoming scarce and increasingly expensive. Consequently, these materials have sometimes been used only as liners in pipes in order to reduce cost.

The prior art includes many attempts to provide good pipe substitutes for briar and meerschaum. However, these alternate materials have not found widespread acceptance, primarily due to taste considerations or considerations relative to the other qualities mentioned earlier One alternative pipe bowl material that has been used is a hollowed cut corncob. Although this is cheap, it has many disadvantages, such as the disadvantage of contributing undesirable and disagreeable taste to the smoke. Also, corncob pipes develop a disagreeable taste after relatively short usage.

Other alternative pipe materials include cherry wood and hickory wood. However, pipes made from these materials have disagreeable tastes and are not popular for this reason. Still further alternative pipe materials include those having a thick plastic outer layer and an extremely thin layer of pyrolytic graphite which serves primarily as thermal insulation. Such pipes are very heavy, and exhibit very poor taste.

U.S. Pat. No. 1,683,959 describes a pipe having an outer shell of wood or similar material and an inner liner of burnt clay and a cementitious mixture (a general term describing a binder material). This pipe was made to simulate clay pipes. It is generally heavy and does not last long. This pipe is made of fragile material and, most importantly, lends a harsh taste to the tobacco and smokes very hot because it is a good conductor of heat. Thus, it is basically a ceramic pipe of heavy weight, high heat conductivity, and poor taste.

U.S. Pat. No. 204,774 describes pipes having carved pumice stone interiors with an outer coating which is applied in a plastic condition and then hardens. Examples of this outer coating include meerschaum chips, compositions of magnesia, plaster of paris, chalk, or other substances which can be applied in a plastic condition and then hardened. The disadvantage of these pipes is that any of the materials suggested lend terrible tastes to the smoking tobacco. Also, such materials as magnesia, plaster of paris, and chalk are brittle and disintegrate when subjected to heat or dropped.

U.S. Pat. No 191,385 also describes a pumice-stone pipe which uses pulverized pumice stone mixed with some cementitious material.

U.S. Pat. No. 1,368,371 describes pipes having an outer wood shell and an inner layer of Portland cement or plaster of paris, or a mixture of these. The disadvantages here are that both plaster of paris and Portland cement paste provide heavy pipes of poor porosity and low heat insulation.

Other patents generally describing pipes which are alternatives to briar and meerschaum pipes include U.S. Pat. No. 379,585 and U.S. Pat. No. 3,695,276. The first of these describes a pipe having an outer bowl of a material such as wood, and an inner bowl of an absorbent material such as paper pulp. This pipe tends to get very hot and the inner lining does not last long. The second patent describes a pipe which is made of a chemical composition including poly (arylene sulfide). This material can be mixed with asbestos, paperbestos, or glass. The main disadvantage of this pipe is its poor taste when smoked.

U.S. Pat. Nos. 2,485,222 and 3,422,821 describe pipes having plastic layers on the outside of the bowl and meerschaum inner linings. As mentioned, these are attempts to obtain the good qualities of meerschaum but at lower cost. The resulting pipes are no better than commonly used briar pipes.

U.S. Pat. No. 1,727,763 describes a smoking pipe having an inner bowl comprised of briar, etc. and an outer bowl of a resin which rigidly contacts the inner bowl. Again, this pipe still requires the use of more expensive materials and does not provide any significant advantages over conventional briar pipes.

In contrast with the prior art pipes mentioned, the present invention is a high-quality pipe that is inexpensive and easy to fabricate. It is comprised of inert materials which will not adversely affect the tobacco taste and which will introduce no chemical impurities into the smoke.

Accordingly, it is a primary object of this invention to provide a pipe which has the qualities of a good, expensive pipe, but which is fabricated from readily available, inexpensive materials.

It is another object of this invention to provide inexpensive substitutes for briar and meerschaum pipes without sacrificing smoking quality.

It is a further object of this invention to provide a smoking pipe of unique composition which does not require extensive "breaking-in" (pre-smoking) before normal use, and which is inexpensive and yet of high quality.

Another object of this invention is to provide a pipe material which can withstand relatively high temperatures, has strength and durability against the cracking, common in other pipe materials, caused by the buildup of carbon in the pipe bowl after extended smoking of the pipe.

SUMMARY OF THE INVENTION

The above and other objects are realized by the invention, one embodiment of which relates to a smoker's tobacco pipe of conventional structure to the extent that it comprises a tobacco burning chamber and a stem communicating with the interior of the chamber and having a bore through which smoke is inhaled in use of the pipe, but wherein the tobacco burning chamber comprises a brass musical instrument mouthpiece, the stem comprises the lead tube of a brass musical instrument attached to a side wall or periphery of the mouthpiece such that the bore of said stem communicates with the interior of said mouthpiece via an opening or portal in the side wall or periphery, and the opening in the mouthpiece for housing a lead tube is sealed.

In a second embodiment of the invention, the pipe is outfitted with a stand apparatus which is removably attached to the mouthpiece and which cooperates with the lead tube to permit positioning of the pipe on a flat surface such that the tobacco burning chamber/mouthpiece is sufficiently perpendicular to the flat surface so as to prevent spillage of the contents thereof when left unattended.

Sealing of the opening in the mouthpiece for housing a lead tube may be permanent or, more preferably, temporary by means of, for example, a removable cap.

Advantageously, the removable cap may be employed to also attach the above-described stand apparatus to the opening in the mouthpiece for housing a lead tube.

DETAILED DESCRIPTION OF THE INVENTION

The present invention is predicated on the discovery that the disadvantages associated with presently available tobacco pipes are overcome by employing a brass musical instrument mouthpiece as the tobacco burning bowl. The mouthpiece is of a shape that achieves optimum burning of the tobacco. Moreover, brass musical instrument mouthpieces are constructed of materials that are neutral to the tobacco burning process and, therefore, contribute no undesirable taste characteristics to the tobacco smoke. Finally, due to the abundance of these mouthpieces, very little manufacturing is required to fabricate the pipes of the invention, and significant cost savings are realized.

Various exemplary embodiments, features, and aspects of the invention will be described in detail below with reference to the drawings.

Figure 1:
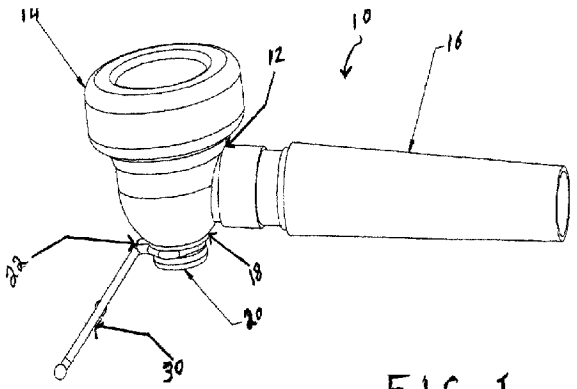
FIG. 1 is an elevational view of a smoker's tobacco pipe according to the invention.
Figure 2:
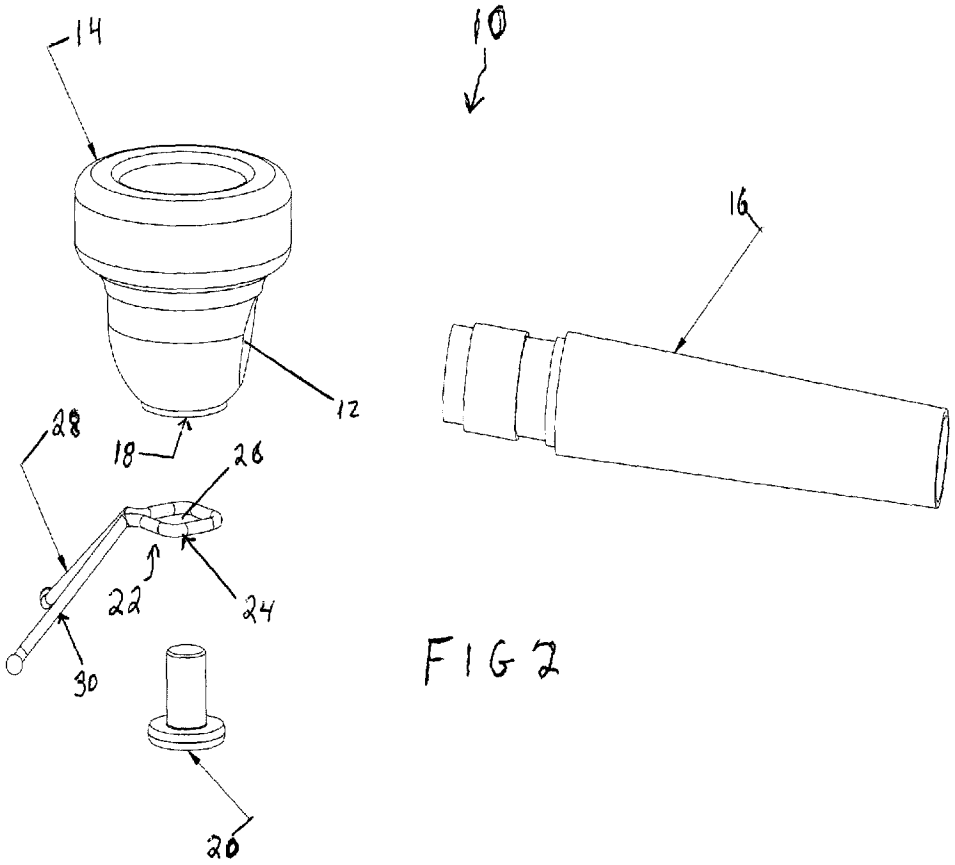
FIG. 2 is an exploded elevational view of the various components of the invention depicted in FIG. 1.

Referring to FIGS. 1 and 2, an inventive embodiment of a tobacco burning smoker's pipe 10 is depicted which comprises tobacco burning bowl (brass musical instrument mouthpiece) 14. Affixed to a side/periphery of bowl 14 via opening/portal 12 is a hollow shaft (lead tube) 16. The lead tube 16 may be secured in the portal 12 by friction engagement, complimentary threads, welding or any other suitable means. The opening 18 for insertion of the lead tube when the mouthpiece is ordinarily employed as part of a musical instrument is removably sealed via friction engagement, complimentary threads or any other suitable means with cap 20.

Optionally, stand apparatus 22 may be interposed between cap 20 and mouthpiece 14, which cooperates with the stem/lead tube 16 to permit positioning of the pipe 10 on a flat surface such that the tobacco burning chamber/mouthpiece 14 is sufficiently perpendicular to the flat surface so as to prevent spillage of the contents thereof when left unattended. Preferably, the stand comprises a ring structure 24 surrounding aperture 26 which permits insertion therethrough of cap 20 for securing the stand 22 to mouthpiece 14 and sealing the latter. Attached to the ring 24 are legs 28 and 30 (not shown in FIG. 1) positioned thereon so as to form a tripod with stem/lead pipe 16 for stabilizing pipe 10 when positioned on a surface and left unattended. It will be understood by those skilled in the art that any suitable means may be attached to ring 24 to provide stabilizing stand apparatus 22.

It will be understood by those skilled in the art that the mouthpiece and lead tube of any brass musical instrument may be utilized in the practice of the invention. Exemplary of such instruments are, for example: trombone, trumpet, French horn, euphonium, and tuba, as well as the cornet, flügelhorn, tenor horn, alto horn, baritone horn, sousaphone, mellophone, saxhorn, bazooka, bugle, cornett, serpent, ophicleide, keyed bugle and keyed trumpet.

It will further be understood by those skilled in the art that the lead tube and mouthpiece need not be from the same musical instrument Most preferred are the mouthpiece and lead tube of a trumpet.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

I claim:

1. A tobacco pipe comprising:

a tobacco burning chamber, comprising a brass musical instrument mouthpiece;

and a stem attached to said chamber, wherein said stem has a bore communicating with an interior of said chamber via a portal and through which bore smoke is inhaled in use of the pipe, wherein said stem comprises a lead tube attached to a side wall or periphery of said mouthpiece such that the bore of said stem communicates with the interior of said mouthpiece through said side wall or periphery, and wherein the brass musical instrument mouthpiece comprises a top opening and a bottom opening separate from the portal, and the bottom opening is removably sealed by a cap.

2. The pipe of claim 1, wherein said stem is permanently attached to said chamber.

3. The pipe of claim 1, wherein said stem is removably attached to said chamber.

4. The pipe of claim 1, further comprising:

a stand apparatus removably attached to the brass musical instrument mouthpiece between the cap and said opening, wherein said stand apparatus cooperates with said stem to permit positioning of said pipe on a flat surface, such that said tobacco burning chamber is sufficiently perpendicular to said flat surface to prevent spillage of the contents thereof when left unattended, and wherein the stand apparatus comprises a ring defining an aperture through which the cap passes through, and further comprising a plurality of legs extending from the ring.

5. The pipe of claim 1, wherein said brass musical instrument is selected from the group consisting of trombone, trumpet, French horn, euphonium, tuba, cornet, flügelhorn, tenor horn, alto horn, baritone horn, sousaphone, mellophone, saxhorn, bazooka, bugle, cornett, serpent, ophicleide, keyed bugle and keyed trumpet.

6. The pipe of claim 4, wherein two legs extend from the ring, the two legs and a distal end of the stem form a tripod.

* * * * *